US011378091B2

(12) United States Patent
Sinico et al.

(10) Patent No.: US 11,378,091 B2
(45) Date of Patent: Jul. 5, 2022

(54) IMPELLER FOR CENTRIFUGAL PUMP, PARTICULARLY FOR PUMP OF THE RECESSED IMPELLER TYPE, AND PUMP WITH SUCH AN IMPELLER

(71) Applicant: DAB PUMPS S.P.A., Mestrino (IT)

(72) Inventors: Francesco Sinico, Montecchio Maggiore (IT); Lorenzo Gobbi, San Martino Buon Albergo (IT); Alessandro Porcari, Busseto (IT)

(73) Assignee: DAB PUMPS S.P.A., Mestrino (IT)

( * ) Notice: Subject to any disclaimer, the term of this patent is extended or adjusted under 35 U.S.C. 154(b) by 0 days.

(21) Appl. No.: 16/919,665

(22) Filed: Jul. 2, 2020

(65) Prior Publication Data

US 2021/0003134 A1 Jan. 7, 2021

(30) Foreign Application Priority Data

Jul. 2, 2019 (IT) ..... 102019000010632

(51) Int. Cl.

| | |
|---|---|
| ***F04D 29/24*** | (2006.01) |
| ***F04D 17/08*** | (2006.01) |
| ***F04D 29/043*** | (2006.01) |
| ***F04D 7/04*** | (2006.01) |
| ***F04D 29/30*** | (2006.01) |
| ***F04D 29/22*** | (2006.01) |
| ***F04D 29/28*** | (2006.01) |

(52) U.S. Cl.

CPC ..... *F04D 29/242* (2013.01); *F04D 7/04* (2013.01); *F04D 7/045* (2013.01); *F04D 17/08* (2013.01); *F04D 29/043* (2013.01); *F04D 29/2216* (2013.01); *F04D 29/2222* (2013.01); *F04D 29/2244* (2013.01); *F04D 29/24* (2013.01); *F04D 29/281* (2013.01); *F04D 29/284* (2013.01); *F04D 29/30* (2013.01)

(58) Field of Classification Search

CPC .. F04D 29/2244; F04D 29/284; F04D 29/242; F04D 29/2222; F04D 29/30; F04D 7/04; F04D 29/281; F04D 7/045; F04D 29/2216

See application file for complete search history.

(56) References Cited

U.S. PATENT DOCUMENTS 244,870 A * 7/1881 Bush ..... B21C 47/24 414/754
2,350,939 A * 6/1944 Sprouse ..... F04D 29/30 416/185

(Continued)

FOREIGN PATENT DOCUMENTS

| | | |
|---|---|---|
| DE | 3305790 A1 | 8/1984 |
| EP | 2226505 A1 | 9/2010 |
| FR | 2640328 A1 | 6/1990 |

OTHER PUBLICATIONS

Italian Search Report dated Mar. 5, 2020 issued in IT 201900010632, with partial translation.

*Primary Examiner* — Peter J Bertheaud

(74) *Attorney, Agent, or Firm* — Scully, Scott, Murphy & Presser, P.C.

(57) ABSTRACT

The present invention relates to an impeller for a centrifugal pump including a recessed impeller pump which provides improved pumping efficiency, is less subject to wear and tear and provides maximal vortex generation.

4 Claims, 6 Drawing Sheets

(56) References Cited

U.S. PATENT DOCUMENTS

| | | | | |
|---|---|---|---|---|
| 2,422,615 | A * | 6/1947 | Halford | F04D 29/284 416/188 |
| 3,384,026 | A | 5/1968 | Williamson, Jr. | |
| 3,637,196 | A * | 1/1972 | Kaelin | C02F 3/16 261/91 |
| 4,676,718 | A * | 6/1987 | Sarvanne | F04D 29/2244 415/225 |
| 5,002,461 | A * | 3/1991 | Young | F04D 29/284 416/183 |
| 8,439,642 | B2 * | 5/2013 | Scott | F04D 29/2288 416/183 |

* cited by examiner

IMPELLER FOR CENTRIFUGAL PUMP, PARTICULARLY FOR PUMP OF THE RECESSED IMPELLER TYPE, AND PUMP WITH SUCH AN IMPELLER

BACKGROUND

The present invention relates to an impeller for centrifugal pump, particularly for centrifugal pump of the recessed impeller type.

The invention also relates to a centrifugal pump with such an impeller.

SUMMARY

The expression "centrifugal pump of the recessed impeller type" is understood to refer to a pump that has an impeller that is recessed with respect to the inlet of the intake duct and utilizes the generation of a single coherent vortex in front of the impeller to impart the centrifugal acceleration to the pumped liquid.

The impeller is constituted by a substantially flat disc from which a plurality of vanes, adapted to move a liquid, extend.

The liquid is aspirated in a direction that is normal to the plane of the disc and sent in a direction that is radial thereto.

The wide use of this type of pump is due to the fact that it has significant capacity for pumping liquid without clogging.

In general, the vanes of the impeller are mutually equidistant, have a rectilinear or curved cross-section on the disc and are extended vertically, remaining at right angles to the disc.

The term "equidistant" in the present description is understood to mean that the corresponding points of the vanes of the impeller are at a constant mutual distance between any vane and the next, on a circumference.

However, such pumps have some drawbacks.

During operation, end vortices form around each vane in the region in front of the impeller and are capable of modifying the trajectories of the liquid flow lines, reducing both head and pumping efficiency.

In order to reduce turbulence and improve pumping efficiency, in recent years impellers have been developed which have complementary discs, arranged opposite the discs, in order to enclose the vanes between the complementary discs and the discs.

As an alternative to the complementary disc, on the market there are impellers wherein each vane ends with a terminal portion, which is parallel to the disc and is extended along the entire curvature of the vane.

However, even these impellers are not free from drawbacks.

These impellers, in fact, are subject to wear and to possible impacts of pumped solid bodies, particularly against complementary discs or terminal portions of the vanes, which can damage them and compromise their operation.

Centrifugal pumps with recessed impeller are also known in which the impeller has a disc that is shaped so as to match the profile of the external ends of the vanes or with non-equidistant vanes.

Even in these centrifugal pumps, however, end vortices for in the region in front of the impeller and are capable of modifying the trajectories of the liquid flow lines, limiting head and pumping efficiency.

Finally, there are impellers in which the vanes have a profile with a double curvature, i.e.:

- a first curvature with respect to a sectional plane that is parallel to the disc, with the concavity directed toward the inside of the impeller;
- a second curvature with respect to a sectional plane that is at right angles to the one of the disc, with the concavity directed toward the outside of the impeller.

The expression "outside of the impeller", in the present description, is understood to mean that the concavity of the vanes is substantially directed toward the external circumference of the disc and/or the projection of said circumference.

The expression "inside of the impeller", in the present description, is understood instead to mean that the concavity of the vanes is substantially directed toward the internal circumference of the disc and/or the projection of said circumference.

Such impellers, which can also have a complementary disc, are adapted to maximize the flow of the liquid in the intervane channel and are designed to work proximate to a fixed surface of the pump body.

In this manner a minimum interstice between impeller and pump body is generated.

These impellers, however, are not of the recessed type and do not generate a coherent vortex in front of the impeller.

The aim of the present invention is to provide an impeller for centrifugal pump, of the recessed impeller type, and a pump with such an impeller that are capable of improving the background art in one or more of the aspects mentioned above.

Within this aim, an object of the invention is to provide an impeller for centrifugal pump, particularly for a pump of the recessed impeller type, that allows to improve the pumping efficiency and the head of the pump in which it is installed with respect to similar impellers of a known type.

Another object of the invention is to provide an impeller for centrifugal pump, particularly for a pump of the recessed impeller type, that is less subject to wear or to impacts by solid bodies with respect to similar impellers of a known type.

Another object of the invention is to provide an impeller for centrifugal pump, particularly for a pump of the recessed impeller type, in which the capacity to generate the vortex is maximized with respect to similar impellers of a known type.

Another object of the invention is to provide a centrifugal pump that has an impeller capable of achieving the aim and objects described above.

A further object of the present invention is to overcome the drawbacks of the background art in a manner that is alternative to any existing solutions.

Another object of the invention is to provide an impeller for centrifugal pump, particularly for a pump of the recessed impeller type, that is highly reliable, relatively easy to provide and at competitive costs.

This aim and these and other objects which will become better apparent hereinafter are achieved by an impeller for centrifugal pump comprising:

- a disc,
- a plurality of vanes which extend from said disc,
- a central body, adapted for connection to a rotating shaft, said impeller being characterized in that each one of said vanes has a profile with a double curvature:

- a first curvature with respect to a sectional plane that is parallel to said disc, a second curvature with respect to a sectional plane that is at right angles to the one of said disc, said first curvature and said second curvature having their concavity directed toward the inside of said impeller.

Further characteristics and advantages of the invention will become better apparent from the description of a preferred but not exclusive embodiment of the impeller for centrifugal pump, according to the invention, illustrated by way of non-limiting example in the accompanying drawings, wherein:

DETAILED DESCRIPTION

Figure 1:
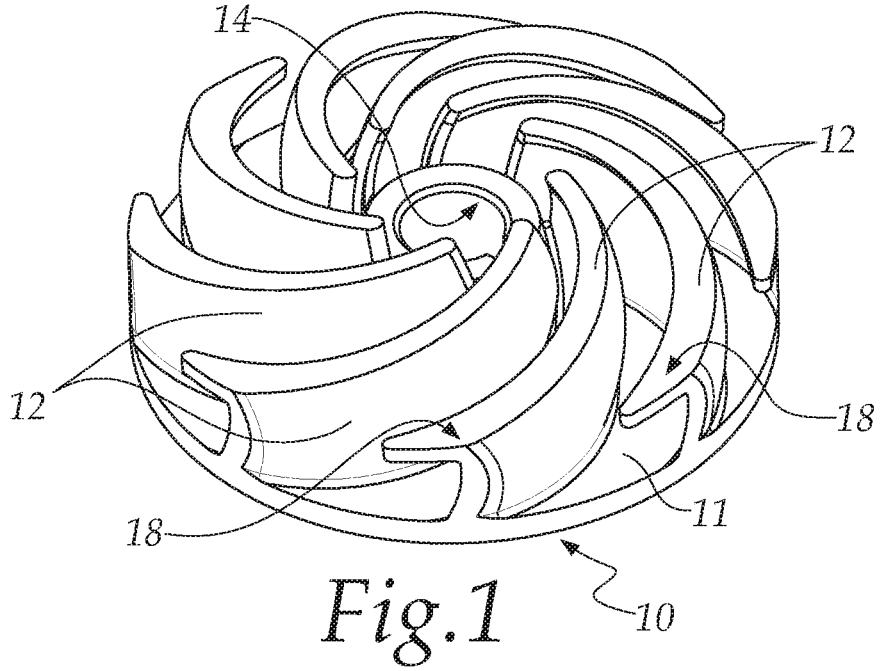
FIG. 1 is a perspective view of an impeller for centrifugal pump, according to the invention.
Figure 2:
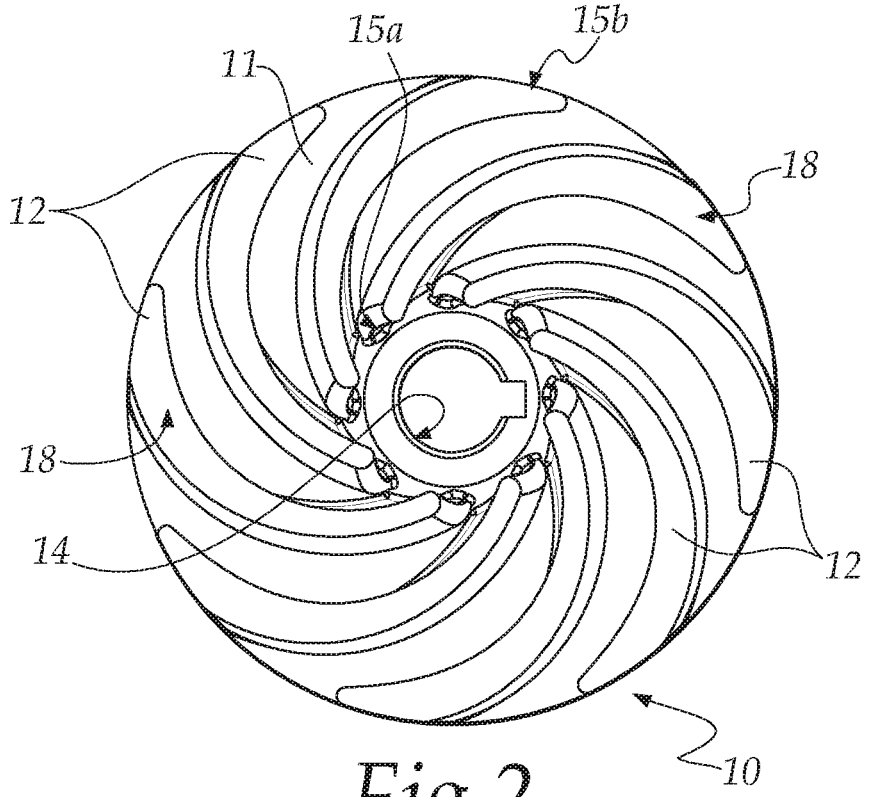
FIG. 2 is a different view of the impeller of FIG. 1.
Figure 3:
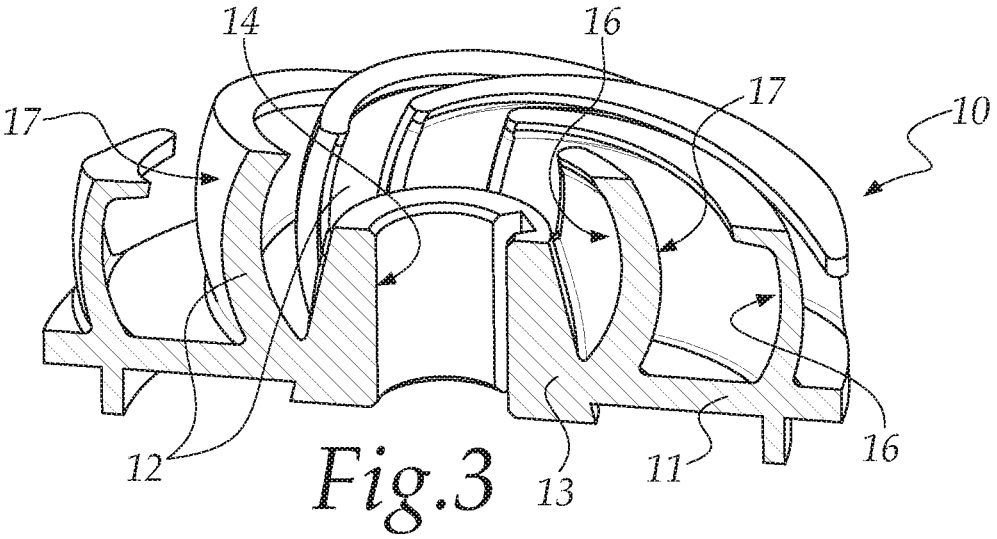
FIG. 3 is a view of a first section of the impeller of FIG. 1.
Figure 4:
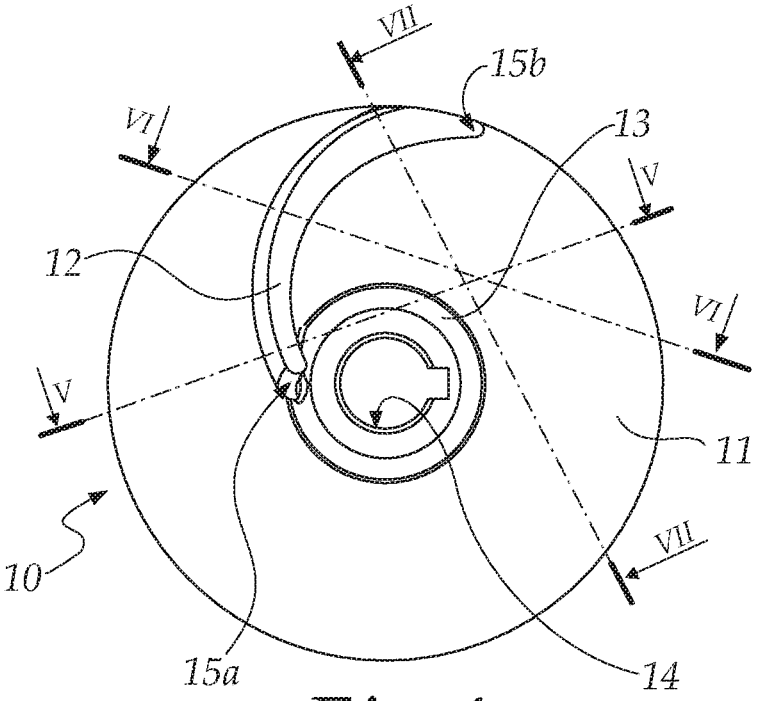
FIG. 4 is a view of an impeller for centrifugal pump, according to the invention, in which a single vane is shown.
Figure 5:
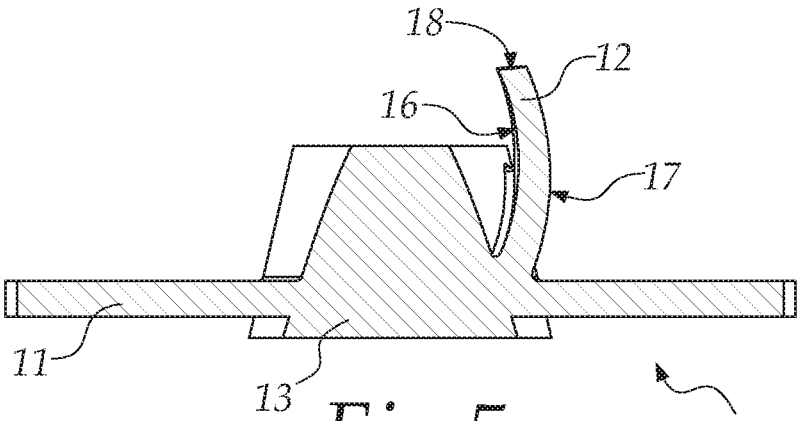
FIG. 5 is a sectional view of the impeller of FIG. 4, taken along the sectional plane V-V.
Figure 6:
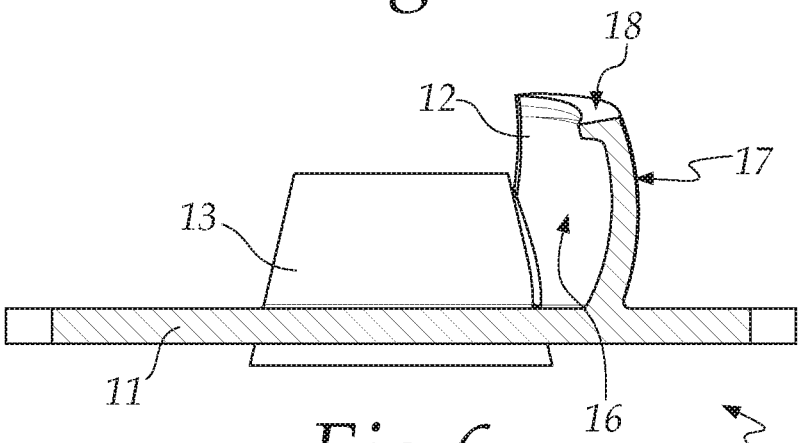
FIG. 6 is a sectional view of the impeller of FIG. 4, taken along the sectional plane VI-VI.
Figure 7:
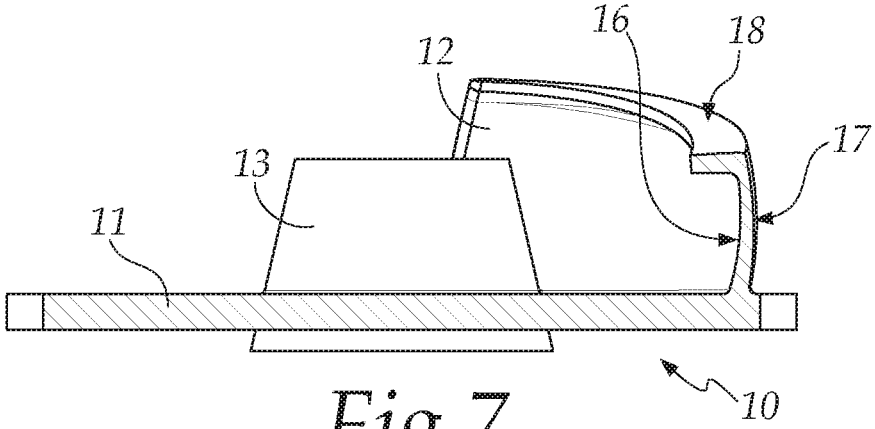
FIG. 7 is a sectional view of the impeller of FIG. 4, taken along the sectional plane VII-VII.
Figure 8A:
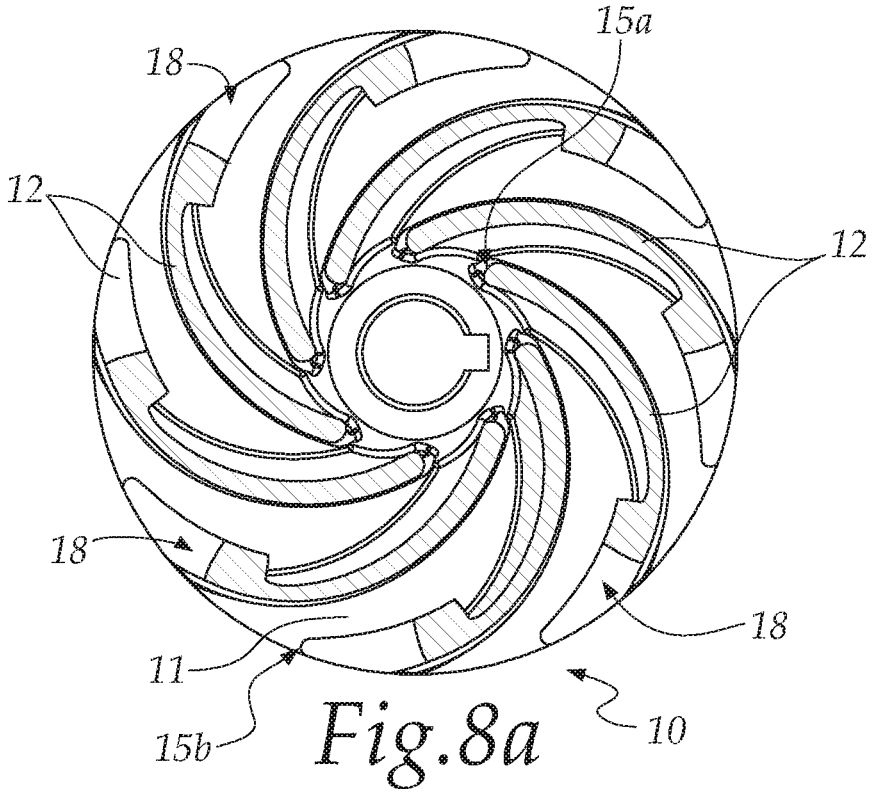
FIGS. 8*a* and 8*b* are two different views of a second section of the impeller of FIG. 1.
Figure 8B:
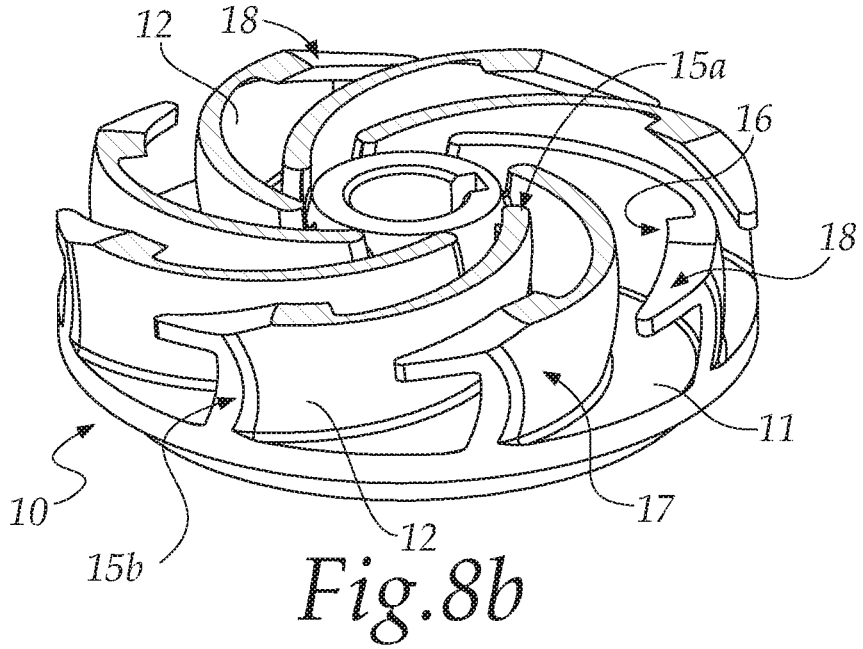
Figure 9A:
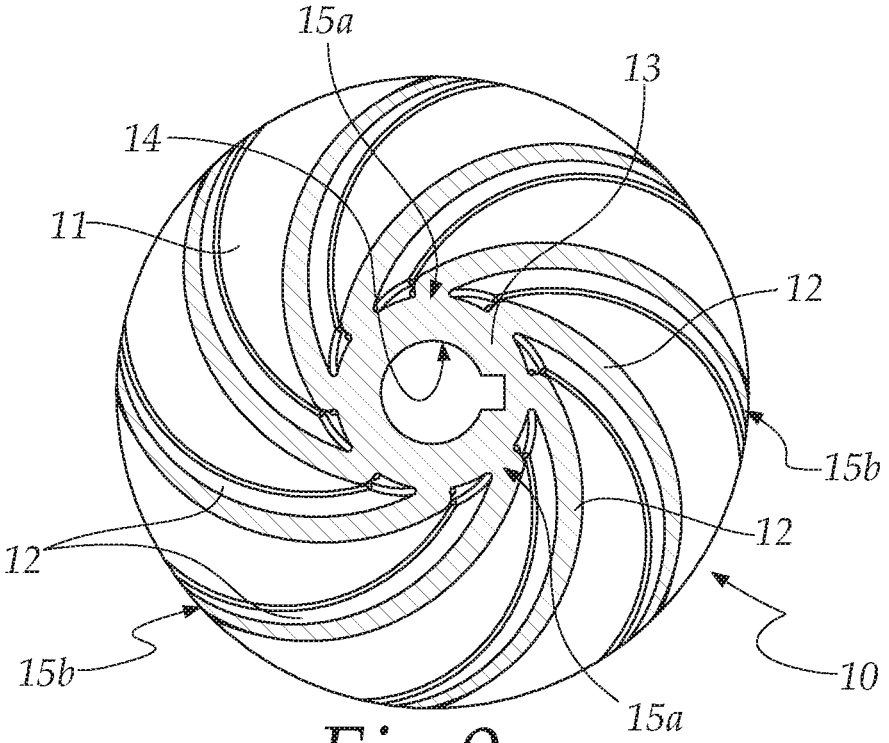
FIGS. 9*a* and 9*b* are two different views of a third section of the impeller of FIG. 1.
Figure 9B:
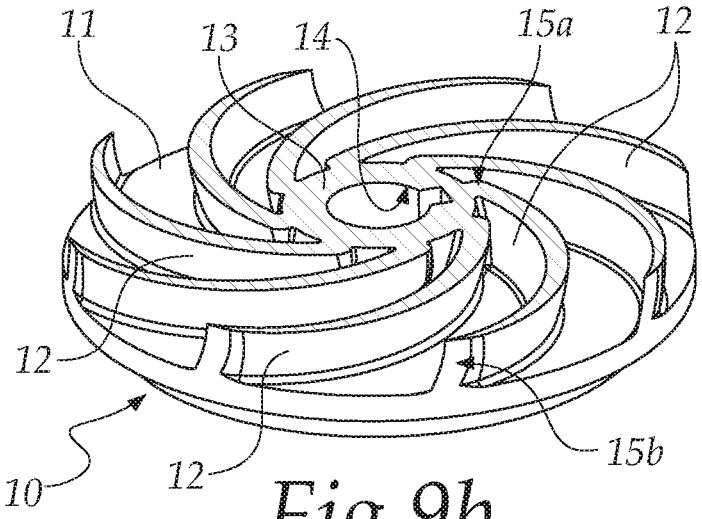

With reference to the figures, the impeller for centrifugal pump according to the invention, particularly but not exclusively for a centrifugal pump with recessed impeller, is generally designated by the reference numeral 10.

The impeller 10 comprises a disc 11 and a plurality of vanes 12 which extends from a surface of this disc 11.

The disc 11 is flat.

One of the particularities of the invention resides in that each one of said vanes 12 has a profile with a double curvature:

a first curvature with respect to a sectional plane that is parallel to the disc 11, as shown in FIGS. 8*a*-9*b;* a second curvature with respect to a sectional plane that is at right angles to the one of the disc 11, as shown in FIGS. 3 and 5 to 7.

In particular, both the first curvature and the second curvature have their concavity directed toward the inside of the impeller 10.

The impeller 10 comprises a central body 13, at the lower circumference of the disc 11, having a through hole 14 adapted for the insertion of a shaft, not shown in the figures, for its rotation.

This central body 13 has a frustum-like shape, with the larger end face substantially at the disc 11 and the smaller end face on the same side of extension as the vanes 12.

The height of the frustum of the central body 13 is lower than the height of the vanes 12, as shown in FIGS. 3 and 5 to 7.

The vanes 12 are equidistant and each vane 12 is extended between:

a first end 15*a*, which is arranged at the central body 13 and is at least partially monolithic therewith, a second end 15*b*, which is arranged at the external circumference of the disc 11.

The frustum-like shape of the central body 13 facilitates the exposure of the first end 15*a* of the vanes outside the influence of the central body 13. In this manner, the capacity for generating the coherent vortex in front of the impeller is increased.

Another particularity of the invention resides in that each vane 12 comprises an inside curve 16 and an outside curve 17 which have different curvatures:

both when considering a sectional plane that is parallel to the disc 11, as visible in FIGS. 8*a* to 9*b,* and when considering a sectional plane that is at right angles to the disc 11, as is clear from FIGS. 3 and 5 to 7.

The expression "inside curve" in the present description is understood to refer to the surface of the vane 12 that is directed toward the central body 13 and is substantially parallel to the lateral surface thereof.

The expression "outside curve" in the present description is understood to refer to the surface of the vane 12 that is opposite the inside curve.

In particular, considering a sectional plane that is perpendicular to the disc 11, such as for example those shown in FIGS. 5 to 7 and 10, the inside curve 16 and the outside curve 17 represent two arcs of circumferences with distinct centers and/or two Non Uniform Rational Basis-Splines (NURBS) with a different number of poles and/or nodes.

In the present description, the expression NURBS is understood to refer to a mathematical model commonly used in computer graphics to generate and represent curves and surfaces and well-known to the person skilled in the art.

With reference to FIGS. 5 to 7 and 9*a*, 9*b*, the thickness of each vane 12 decreases uniformly from a maximum value, at the first end 15*a*, to a minimum value at the second end 15*b*.

The expression "thickness of the vane", in the present description, is understood to refer to the distance between corresponding points of the inside curve 16 and the outside curve 17.

Depending on the requirements, the thickness of the vane can be constant.

In particular, in the case shown by way of non-limiting example in the figures, in which the thickness of the vane 12 is variable, the thickness at the first end 15*a* is on the order of 0.3-1 cm, for example 0.4 cm, while the thickness of the vane 12 at the second end 15*b* is on the order of 0.15-0.8 cm, for example 0.2 cm.

The height of each vane 12 also decreases uniformly from a maximum value, at the first end 15*a*, to a minimum value at the second end 15*b*.

The term "height", in the present description, is understood to refer to the dimension at right angles to the disc 11.

In particular, the height of the vane 12 at the first end 15*a* is, for example, on the order of 2-10 cm, for example 3 cm, while the height of the vane 12 at the second end 15*b* is on the order of 0.5-9 cm, for example 1.6 cm.

Each vane 12 comprises a terminal portion 18, opposite the disc 11.

The terminal portion 18, monolithic with the vane 12, extends from the outside curve 17 of the vane 12 toward the inside of the impeller 10 and has an extension along the entire first curvature of the vane 12.

In particular, the terminal portion 18 has a width equal to the thickness of the vane 12, at the first end 15*a*, and increases in the direction of the second end 15*b*, in which it is greatest.

The expression "width of the terminal portion" in the present description is understood to refer to the distance between the edge of the terminal portion 18 directed toward the outside of the impeller 10, which coincides with the outside curve 17 of the vane 12, and the edge directed toward the inside of the impeller 10, which coincides with the inside curve 16 only at the first end 15*a*.

The maximum width of the terminal portion 18 is on the order of 0.5-7 cm, for example 0.7 cm.

For example, the maximum width of the terminal portion 18 is smaller than or equal to the half-distance between the inside curve of one vane 12 and the outside curve of the next one.

The terminal portion 18 protrudes from the inside curve 16 of the vane 12 toward the inside of the impeller 10, at least starting from a region that is proximate to the second end 15*b*.

Figure 10:
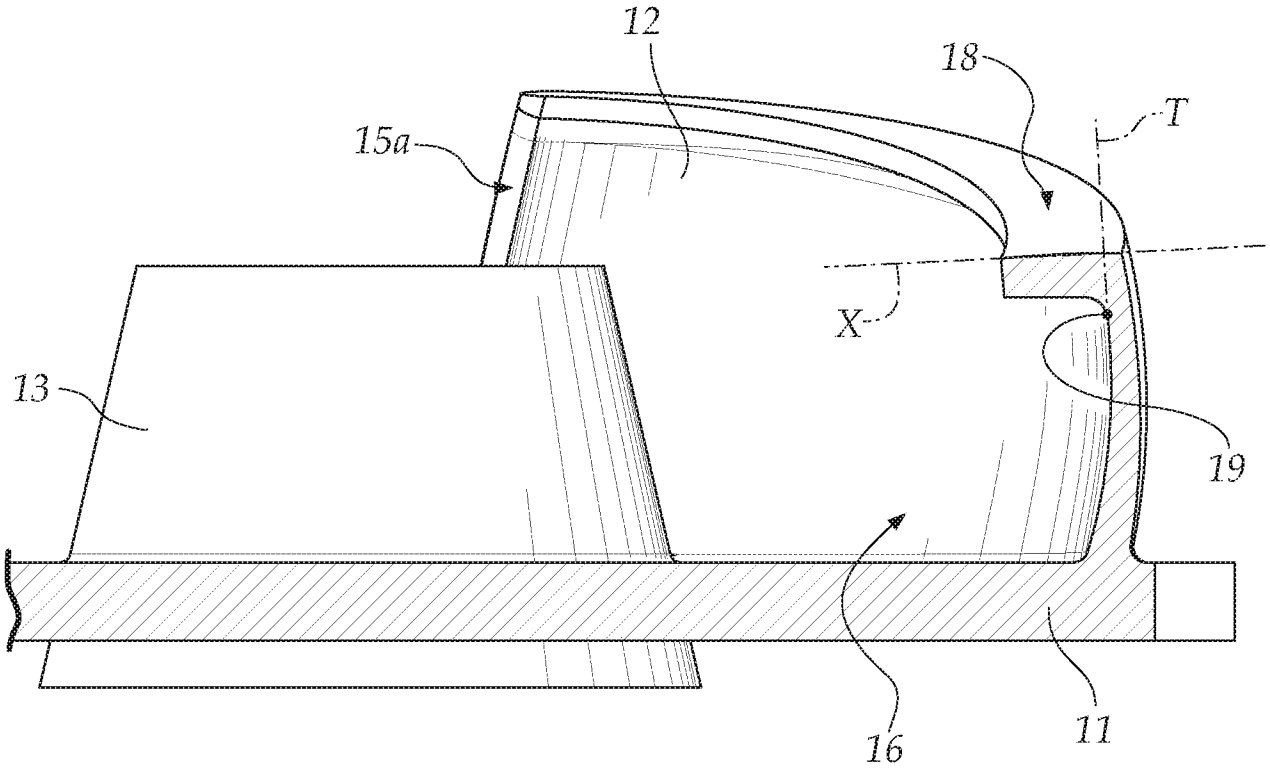
FIG. 10 is an enlarged-scale view of a detail of the sectional view of FIG. 7.

In particular, with reference to FIG. 10, the region of the terminal portion 18 that protrudes from the inside curve 16 is extended locally in a direction X that is at right angles to the tangent T to the inside curve 16 in the point 19 of the inside curve 16 that is furthest from the disc 11, considering a sectional plane that is at right angles to the disc 11.

The expression "is extended locally" in the present description is understood to mean that in each section of the vane 12, which is at right angles to the disc 11, in which the terminal portion 18 protrudes from the inside curve 16, said terminal portion 18 has an extension in a direction X that is at right angles to the tangent T to the inside curve 16 in the point 19 of the inside curve 16 that is furthest from the disc 11.

In this manner, the terminal portion 18 of a vane 12 does not interfere with the contribution to the generation of the vortex of the next vane and wear and possible damage caused by impacts with solid bodies are reduced.

The particular shape of the vanes 12 allows to improve the pumping efficiency and the head of the pump in which it is installed with respect to similar impellers of a known type.

In order to define the curvature of the inside curve 16 and of the outside curve 17 with respect to a sectional plane at right angles to the disc 11 it is possible, for example:

- to perform a first simulation by means of CFD (Computational Fluid Dynamics) software, setting up a geometry of the vane 12 according to parameters known from the literature in the field, well-known to the person skilled in the art, in order to obtain a range of the starting pressures,
- to position the poles of the NURBS so that the curvature of the inside curve 16 and of the outside curve 17 is adapted as much as possible to the range of pressures obtained from the first simulation,
- to perform a simulation again, obtaining a second range of pressures,
- to position and/or add poles of the NURBS so that the curvature of the inside curve 16 and of the outside curve 17 adapts as much as possible to the range of pressures just obtained,
- to iterate the method until values of the pressures of the range that substantially correspond or with a difference of less than 1% are obtained in two subsequent simulations.

The greater the number of poles of the NURBS, the better the contouring of the inside curve and of the outside curve for matching the range of pressures and therefore the greater the capacity of the vane 12 to imparting momentum to the pumping vortex.

It should be noted that the vanes 12, with the second curvature directed toward the inside of the impeller 10, reduce the power absorbed by the liquid, increasing the vortex generation capacity, with respect to similar impellers of a known type.

In practice it has been found that the invention has achieved the intended aim and objects, providing an impeller for centrifugal pump, particularly for a pump of the recessed impeller type, that allows to improve the pumping efficiency and the head of the pump in which it is installed with respect to similar impellers of a known type.

The invention provides an impeller for centrifugal pump, particularly for a pump of the recessed impeller type, that is less prone to wear or to impacts from solid bodies with respect to similar impellers of a known type and in which the capacity of generating the vortex is maximized with respect to similar impellers of a known type.

The invention also provides a centrifugal pump that has an impeller capable of reaching the aim and objects proposed above.

The invention thus conceived is susceptible of numerous modifications and variations, all of which are within the appended claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102019000010632 from which this application claims priority are incorporated herein by reference.

What is claimed is:

1. An impeller for a recess impeller type centrifugal pump, comprising:

- a disc,
- a plurality of vanes which extend from said disc,
- a central body, adapted for connection to a rotating shaft,
- wherein each one of said vanes has a profile with a double curvature:
  - a first curvature with respect to a sectional plane that is parallel to said disc,
  - a second curvature with respect to a sectional plane that is perpendicular to said disc,
  - said first curvature and said second curvature having their concavity directed toward an inside of said impeller, wherein said vanes are equidistant and each one of said vanes is extended between:
    - a first end, which is arranged at said central body and is at least partially monolithic therewith,
    - a second end, which is arranged at the external circumference of said disc,
  - wherein each one of said vanes comprises an inside curve and an outside curve, which have different curvatures: both when considering a sectional plane that is parallel to said disc,
    - and when considering a sectional plane that is perpendicular to said disc,
  - wherein said inside curve and said outside curve represent two arcs of circles with distinct centers and/or two Non Uniform Rational Basis-Splines (NURBS) with a different number of poles and/or nodes, when considering a sectional plane that is perpendicular to said disc,
  - wherein each one of said vanes comprises a terminal portion, which is opposite with respect to said disc,
  - wherein said terminal portion that protrudes from said inside curve comprises an extension, in a direction that is perpendicular to a tangent to said inside curve, in a point of said inside curve that is furthest from said disc, considering a sectional plane that is perpendicular to said supporting disc, and wherein said terminal portion protrudes from said inside curve of each one of said vanes toward the inside of the impeller, starting from the second end to a portion a distance from the first end.

2. The impeller according to claim 1, wherein said terminal portion:

is monolithic with a vane of said vanes, extends from said outside curve toward the inside of said impeller, has an extension along all of said first curvature of said vane.

3. The impeller according to claim 1, wherein said terminal portion has a width that is equal to the thickness of said vane at said first end, said width increasing in a direction of said second end, said width being maximum at said second end.

4. A centrifugal pump, comprising an impeller according to claim 1.

* * * * *